US010378474B2

(12) United States Patent
Hirchenhein et al.

(10) Patent No.: US 10,378,474 B2
(45) Date of Patent: Aug. 13, 2019

(54) METHOD AND DEVICE FOR ASCERTAINING A CORRECTION VALUE FOR A FUEL INJECTION QUANTITY

(71) Applicant: Robert Bosch GmbH, Stuttgart (DE)

(72) Inventors: Achim Hirchenhein, Bietigheim-Bissingen (DE); Alexander Schenck Zuschweinsberg, Moeglingen (DE); Klaus Joos, Walheim (DE); Michael Bauer, Gerlingen (DE); Werner Hess, Stuttgart (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 15/561,180

(22) PCT Filed: Mar. 8, 2016

(86) PCT No.: PCT/EP2016/054846
§ 371 (c)(1),
(2) Date: Sep. 25, 2017

(87) PCT Pub. No.: WO2016/155986
PCT Pub. Date: Oct. 6, 2016

(65) Prior Publication Data

US 2018/0106208 A1 Apr. 19, 2018

(30) Foreign Application Priority Data

Apr. 1, 2015 (DE) ..... 10 2015 205 877

(51) Int. Cl.
*F02D 41/24* (2006.01)

(52) U.S. Cl.
CPC .. *F02D 41/2467* (2013.01); *F02D 2200/0602* (2013.01); *F02M 2200/247* (2013.01)

(58) Field of Classification Search
CPC ..... F02D 41/2467; F02D 2200/0602; F02M 2200/247
See application file for complete search history.

(56) References Cited

U.S. PATENT DOCUMENTS

2010/0088006 A1* 4/2010 Ito ..... F02D 41/2096 701/103
2010/0121600 A1* 5/2010 Zieher ..... F02D 41/222 702/98

(Continued)

FOREIGN PATENT DOCUMENTS

DE 102007050813 A1 4/2009
DE 102009002593 A1 10/2010

(Continued)

OTHER PUBLICATIONS

International Search Report dated May 25, 2016, of the corresponding International Application PCT/EP2016/054846 filed Mar. 8, 2016.

*Primary Examiner* — Sizo B Vilakazi
(74) *Attorney, Agent, or Firm* — Norton Rose Fulbright US LLP; Gerard Messina

(57) ABSTRACT

A method for ascertaining a correction value for a fuel metering of a fuel injector of an internal combustion engine, in which fuel is injected from a high pressure accumulator into a combustion chamber with the aid of the fuel injector, a value which is representative for a static flow rate through the fuel injector being ascertained by way of ascertaining, during at least one injection process of the fuel injector, a ratio of a pressure difference occurring in the high pressure accumulator as a result of the injection process and an associated duration which is characteristic for the injection process, and the correction value being ascertained on the basis of a comparison of the representative value with a comparative value.

14 Claims, 3 Drawing Sheets

(56) References Cited

U.S. PATENT DOCUMENTS

| | | | | |
|---|---|---|---|---|
| 2014/0007847 | A1* | 1/2014 | Joos | F02D 41/2432<br>123/472 |
| 2014/0100761 | A1* | 4/2014 | Empacher | F02D 41/2467<br>701/104 |

FOREIGN PATENT DOCUMENTS

| | | | |
|---|---|---|---|
| DE | 102011002764 | A1 | 7/2012 |
| EP | 2184473 | A2 | 5/2010 |
| JP | H07197840 | A | 8/1995 |
| JP | 2000018068 | A | 1/2000 |
| JP | 2014503044 | A | 2/2014 |

* cited by examiner

METHOD AND DEVICE FOR ASCERTAINING A CORRECTION VALUE FOR A FUEL INJECTION QUANTITY

FIELD

The present invention relates to a method for ascertaining a correction value for a fuel metering of a fuel injector of an internal combustion engine, in which fuel is injected from a high pressure accumulator into a combustion chamber with the aid of the fuel injector.

BACKGROUND INFORMATION

Motor vehicles are subject to limiting values, some of which are very strict, with respect to emissions of pollutants which are to be complied with. A precise fuel metering, inter alia, during injection is decisive in order to comply with present and, in particular, future emissions and exhaust gas limiting values.

In this case, it is to be taken into consideration, however, that different tolerances occur during the metering. Such metering tolerances generally result from specimen-dependent needle dynamics and specimen-dependent static flow rates of the fuel injectors. An influence of the needle dynamics may be reduced, for example, by way of a mechatronic approach, such as, for example, a so-called controlled valve operation. In a controlled valve operation, control times of the fuel injectors in the sense of a regulation are adapted, for example, throughout the service life of a motor vehicle. In this case, the control signal is detected during the injection and, in parallel thereto, the opening duration of the valve needle is ascertained from the opening and closing timing. Therefore, the actual opening duration of each injector may be calculated and, if necessary, corrected.

Such a method for regulating an actual opening duration of a valve to a setpoint opening duration is described in German Patent Application No. DE 10 2009 002 593 A1.

Possible errors in the static flow rate result from tolerances of the injection hole geometry and the needle lift. Such errors may so far usually only be corrected globally, i.e., jointly with respect to all fuel injectors of an internal combustion engine, for example on the basis of a lambda control or a mixture adaptation. As a result, it may not be detected, however, whether individual fuel injectors of the internal combustion engine have a deviation with respect to their static flow rate (i.e., they deliver different quantities during the same opening duration), which may be relevant in terms of exhaust gas or engine smoothness.

German Patent Application No. DE 10 2007 050 813 A1 describes, for example, a method for monitoring the delivery quantity of an injector control unit of an internal combustion engine, in which a fuel quantity delivered by the injector is monitored on the basis of a pressure drop in the high pressure accumulator. A detailed ascertainment of causes of possible deviations, and the correction thereof, is therefore not possible, however.

It is therefore desirable to provide a possibility for a more accurate monitoring and/or correction of a fuel metering in fuel injectors of internal combustion engines.

SUMMARY

Advantageous embodiments of the present invention are described herein.

An example method according to the present invention may be used for ascertaining a correction value for a fuel metering of a fuel injector of an internal combustion engine, in which fuel is injected from a high pressure accumulator into a combustion chamber with the aid of the fuel injector. In this case, a value which is representative for a static flow rate through the fuel injector is ascertained by way of ascertaining, in at least one injection process of the fuel injector, a ratio of a pressure difference occurring in the high pressure accumulator as a result of the injection process and an associated duration which is characteristic for the injection process. The value which is representative for the static flow rate through the fuel injector is therefore a pressure rate. In addition, the correction value is then ascertained on the basis of a comparison of the representative value with a comparative value, for example by forming the quotient.

The correction value is then preferably utilized for correcting a value for the static flow rate, the value being used in the ascertainment of setpoint durations or times which are characteristic for the injection process, for example a setpoint opening duration or a setpoint control period. For example, the previous value for the static flow rate may be multiplied by the correction value. In particular, the correction may take place during the operation of a motor vehicle, in particular also regularly, or during a maintenance operation or another type of inspection.

The present invention makes use of the fact that the fuel quantity, or its volume, delivered by a fuel injector during an injection process is proportional or at least sufficiently proportional to the associated pressure difference, i.e., the pressure difference before and after the injection process, in the high pressure accumulator, the so-called rail. When a duration which is characteristic for the injection process is now also known, a value may be ascertained from the ratio of this pressure difference and the associated duration, which corresponds to the static flow rate through the fuel injector, minus a proportionality factor.

By taking into account the static flow rate, i.e., the injection quantity per unit of time in the full lift, the injection duration for injecting a desired injection quantity may be even more precisely predefined. Since this method may be carried out for each fuel injector of the internal combustion engine, injector-specific deviations in the fuel metering, which may not be detected via a lambda measurement, for example, in a global adaptation of the total injection quantity, may therefore be corrected. Deviations in the needle dynamics (i.e., the opening and closing timing), however, may be corrected with the aid of a mechatronic method mentioned at the outset. Suitable and precise methods are therefore available for each of the two factors influencing the fuel metering, i.e., the needle dynamics and the static flow rate.

Preferably, the representative value is ascertained from ratios of the pressure difference and the associated duration, which are ascertained in multiple injection processes of the fuel injector. Since the accuracy resulting from an individual measurement of the pressure difference and the duration which is characteristic for the injection is limited, considerably more accurate values may be attained by way of carrying out multiple measurements which are set in relation to each other in a suitable way.

Advantageously, the representative value is ascertained from a mean value of ratios of the pressure difference and the associated duration ascertained in multiple injection processes of the fuel injector, since averaging is very easily carried out and yields an accurate value. A necessary number of measurements is usually dependent, in this case, on typical pulsations in the high pressure accumulator and an accuracy of the sensor utilized for the pressure in the high pressure accumulator.

Advantageously, the correction value is ascertained on the basis of a ratio of the representative value and a mean value of corresponding representative values of all fuel injectors of the internal combustion engine as the comparative value. The method is therefore independent of possible systematic measuring errors, for example, due to inaccurate sensors or missing information regarding the present fuel properties, such as, for example, temperature or ethanol content. These influence factors are eliminated due to the quotient formation. In addition, the proportionality factor does not need to be taken into account. In this case, it is to be noted that the representative values of all fuel injectors are each advantageously ascertained in the same way. Provided that a sufficient number of sufficiently accurate sensors, for example, for the pressure in the high pressure accumulator, the medium temperature, and ethanol content, are utilized or may be utilized, an absolute value for the static flow rate may therefore also be ascertained. The correction value may be ascertained on the basis of a ratio of this absolute value and a desired value as the comparative value.

It is advantageous when the mean value of the corresponding correction values of all fuel injectors of the internal combustion engine is adjusted in such a way that a desired fuel-oxygen ratio in the exhaust gas is not changed. This fuel-oxygen ratio is also referred to as the lambda value in this case. Exhaust gas values of the internal combustion engine, which are preferably optimal, for example, may therefore be attained.

Preferably, an actual opening duration (i.e., the measured duration between the opening timing and the closing timing), a setpoint opening duration (i.e., the ideal model opening duration, i.e., a non-measured opening duration), a control duration, i.e., the time period in which a control signal is present at the valve, and/or a closing time, i.e., the time from the end of the control period up to the end of the opening duration, are taken into account in the ascertainment of the duration which is characteristic for the injection process of the fuel injector. Although the actual opening duration is the value by which the duration of the fuel flow during the injection process is most accurately described, the other variables, possibly including a correction, may also be sufficiently accurate for the determination of the relevant duration of the injection process; above all, some of these are very easy to ascertain. A combination of two or more of the aforementioned variables may yield even more accurate values. Which variables are utilized may be made dependent, in this case, for example on available detection means such as sensors or on data in the control electronics system. The actual opening duration may be ascertained in this case, for example with the aid of the controlled valve operation mentioned at the outset, in which, after all, the injection duration is adjusted.

Advantageously, processes increasing a pressure in the high pressure accumulator during the at least one injection process are prevented. This includes, in particular, preventing or interrupting the post-delivery of fuel into the high pressure accumulator by a high pressure pump. The pressure difference in the high pressure accumulator due to the injection process may otherwise possibly not be sufficiently accurately detected or it is corrupted. Possible leakages, which also result in a loss of pressure, are not significant, however, in particular in the relative determination of the correction value, in which the representative value of one fuel injector is put into proportion to a mean value of corresponding representative values of all fuel injectors.

A processing unit according to the present invention, for example a control unit, in particular an engine control unit of a motor vehicle, is configured, in particular via programming, to carry out a method according to the present invention.

The implementation of the method in the form of software is also advantageous, since this generates particularly low costs, in particular when an executing control unit is also used for further tasks and is therefore present anyway. Suitable data carriers for providing the computer program are, in particular, magnetic, electrical, and optical memories, such as hard drives, flash memories, EEPROMs, DVDs, and others. It is also possible to download a program via computer networks (Internet, intranet, etc.).

Further advantages and embodiments of the present invention result from the description below and the figures.

The present invention is schematically represented in the figures on the basis of an exemplary embodiment and is described below reference to the figures.

DETAILED DESCRIPTION OF EXAMPLE EMBODIMENTS

Figure 1:
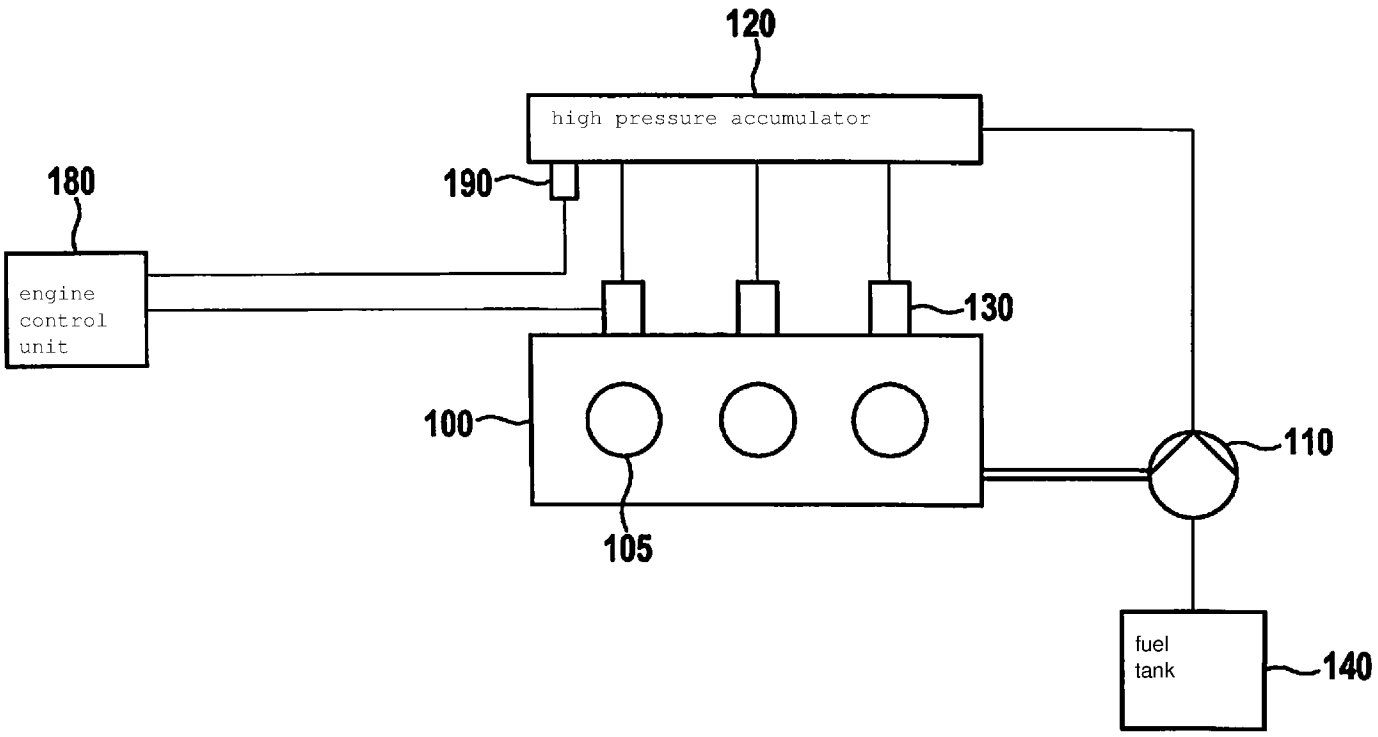
FIG. 1 schematically shows an internal combustion engine including a common rail system, which is suitable for carrying out a method according to the present invention.

FIG. 1 schematically shows an internal combustion engine 100 which is suitable for carrying out a method according to the present invention. By way of example, internal combustion engine 100 includes three combustion chambers and associated cylinders 105. Assigned to each combustion chamber 105 is a fuel injector 130 which, in turn, is connected in each case to a high pressure accumulator 120, a so-called rail, via which it is supplied with fuel. It is understood that a method according to the present invention may also be carried out in an internal combustion engine including any other number of cylinders, for example four, six, eight, or twelve cylinders.

In addition, the high pressure accumulator is supplied with fuel from a fuel tank 140 via a high pressure pump 110. High pressure pump 110 is coupled to internal combustion engine 100 and, in fact, for example, in such a way that the high pressure pump is driven via a crankshaft of the internal combustion engine, or via a camshaft which, in turn, is coupled to the crankshaft.

A control of fuel injectors 130 for metering fuel into particular combustion chambers 105 takes place via a processing unit designed as engine control unit 180. For the sake of clarity, only the connection of engine control unit 180 to one fuel injector 130 is represented, although it is understood that each fuel injector 130 is correspondingly connected to the engine control unit. Each fuel injector 130 may be specifically controlled in this case. Furthermore, engine control unit 180 is configured for detecting the fuel pressure in high pressure accumulator 120 with the aid of a pressure sensor 190.

Figure 2:
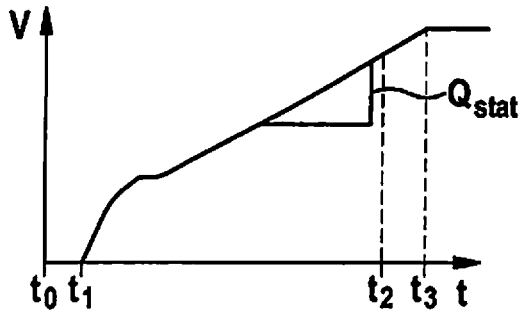
FIG. 2 shows, in a diagram, a flow volume in a fuel injector over time.

FIG. 2 shows, in a diagram, a cumulative flow volume V through a fuel injector over time t in the case of a long-lasting control of the fuel injector. A control time begins at point in time $t_0$ in this case, and the valve needle begins to lift at point in time $t_1$. An opening duration of the fuel injector therefore also begins at point in time $t_1$. In this case, it is clear that cumulative flow volume V or the fuel quantity which has flowed through the fuel injector increases constantly over a wide range after a short time period during the lifting of the valve needle. In this range, the valve needle is in so-called full lift, i.e., the valve needle has been lifted completely or up to a setpoint height.

During this time, a constant fuel quantity per unit of time flows through the valve opening of the fuel injector, i.e., the static flow rate $Q_{stat}$, which indicates the slope of cumulative flow volume V, is constant. The magnitude of the static flow rate is an essential factor which, as mentioned at the outset, determines the total fuel quantity injected during an injection process. Deviations or tolerances in the static flow rate therefore have an effect on the injected fuel quantity per injection process.

At point in time $t_3$, the control time ends and the closing time begins. The valve needle begins to lower at this point. The closing time and the opening duration end at point in time $t_4$, when the valve needle completely closes the valve again.

Figure 3:
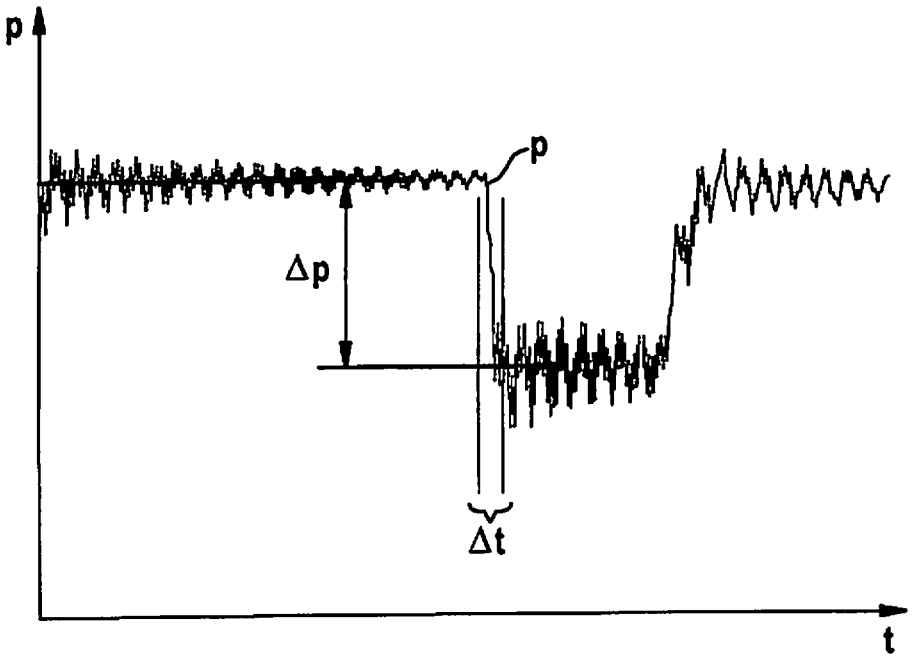
FIG. 3 shows, in a diagram, a pressure profile in a high pressure accumulator during an injection process.

A pressure profile p in a high pressure accumulator during an injection process is represented over time t in a diagram in FIG. 3. In this case, it is clear that pressure p in the high pressure accumulator is essentially constant, apart from certain fluctuations due to pumping and fuel withdrawals for injections. During the injection process, which lasts for a time period Δt, pressure p in high pressure accumulator drops by a value Δp.

Subsequently, pressure p—apart from certain fluctuations—remains again at the lower level until pressure p rises back to the starting level due to a post-delivery by the high pressure pump.

The detection and evaluation of these pressure drops in injection processes takes place, in this case, with the aid of components which are usually present anyway, such as, for example, pressure sensor 190 and engine control unit 180, including the corresponding input circuitry. Additional components are therefore not necessary.

This evaluation takes place individually for each combustion chamber 105 and, therefore, individually for each injector. As a result, a metering variation between the combustion chambers is reduced and, for example, carbonized or defective injectors may be better identified, for example in the repair shop (using a tester).

Static flow rate $Q_{stat}$ through the fuel injector, as mentioned above, is characterized by the injected fuel quantity or its volume per unit of time. In a high pressure accumulator or rail, which has been pumped up to system pressure, the injected volume is proportional to the pressure drop in the rail. The associated time duration corresponds, in this case, to the opening duration of the fuel injector, which, for example, as mentioned above, may be determined mechatronically with the aid of a so-called controlled valve operation.

Forming a quotient between the pressure drop or pressure difference Δp and the opening duration or time duration of injection Δt yields a pressure rate as a substitute value or representative value Δp/Δt for static flow rate $Q_{stat}$, i.e., the following applies for a measuring process i:

$$Q_{stat,i} = \frac{\Delta p_j}{\Delta t_j}.$$

A post-delivery by the high pressure pump should not fall within the relevant time window in this case. A post-delivery is therefore to be suppressed, if necessary.

Since this substitute value for $Q_{stat}$ may generally be determined using the components available in the system only with a certain level of accuracy, a suitable method for refinement is useful. This may be achieved, for example, using averaging or another mathematical method with the aid of a suitable software implementation. The determination error is reduced in the averaging as the number of individual measurements increases. The following therefore results, for example, for n measuring processes $$Q_{stat,i} = \frac{1}{n}\sum_{j=1}^{n}\frac{\Delta p_j}{\Delta t_j}.$$

A minimum number of measurements is necessary in this case in order to achieve a required level of accuracy. If the required number of measurements has been reached, a significant substitute variable for static flow rate $Q_{stat}$ is present.

In this way, suitable substitute variables or representative values may be formed for all injectors. In addition, the injector-specific correction advantageously takes place in a relative manner, i.e., the injector-specific substitute variable is put into proportion to the mean value of the corresponding substitute variables of all fuel injectors as the comparative value. Due to this relative approach, the method is independent of, for example, absolute errors of the pressure sensor or the fuel temperature. In this way, a correction value of the form $$K_t = \frac{Q_{stat,i}}{Q_{stat}}$$

results, for example, in which $$\overline{Q}_{stat} = \frac{1}{Z}\sum_{i=1}^{Z} Q_{stat,i},$$

in which Z is the number of cylinders or injectors. It is also clear in this case that possible proportionality factors or systematic measuring errors are eliminated in the quotient formation.

A global mean value offset of static flow rate $\overline{Q}_{stat}$, i.e., an offset of the mean value of the static flow rates of all fuel injectors of the internal combustion engine, is not corrected with the aid of this relative approach and is compensated for, for example, with the aid of the so-called lambda control or adaptation, as is also possible without a correction of the static flow rate of individual fuel injectors.

The correction value is now utilized, for example, for correcting the control duration as a setpoint duration which is characteristic for the injection process by way of multiplying a value for the static flow rate, which is utilized in the ascertainment of the control duration, by the correction value. This takes place, for example, in the form of a factor which assigns a separate conversion factor to each fuel injector in the series of calculations of setpoint fuel quantity with respect to control duration, i.e., an injector-specific value results for the particular static flow rate.

The described correction of the static flow rate yields particularly accurate results when the influences of the needle dynamics are minimized or at least reduced by way of an underlying method such as, for example, a controlled valve operation, and therefore an approximately linear correlation is present between the injected volume of fuel and a measurable time (opening duration). Therefore, the two greatest metering errors, namely errors in the needle dynamics and in the static flow rate, may be physically correctly compensated for using separate methods.

A preferably optimal equivalence of the metering accuracy of all fuel injectors may be provided by combining the two methods. An absolute consideration is also possible in systems having sufficiently accurate detection of pressure, temperature, and media, which require no correction via a measurement of the fuel-oxygen ratio, for example with the aid of lambda control, as mentioned above.

Figure 4:
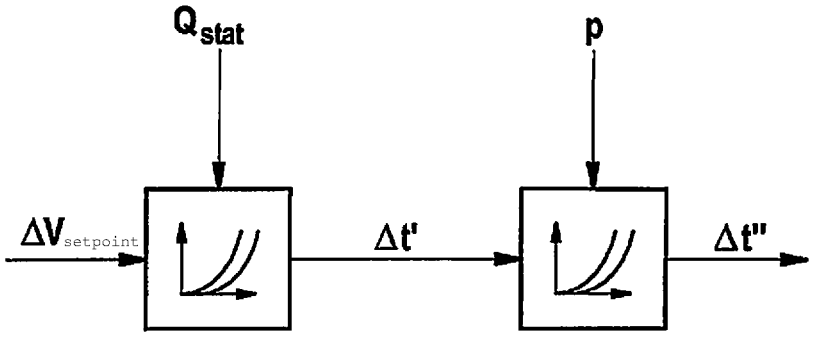
FIG. 4 schematically shows a sequence for ascertaining a control time for a fuel injector.

A sequence for ascertaining a control time Δt" for a fuel injector on the basis of a value $Q_{stat}$ for a static flow rate is schematically shown in FIG. 4. From a setpoint injection quantity $\Delta V_{setpoint}$ and value $Q_{stat}$ for the static flow rate, which has been corrected with the aid of an ascertained correction value, if necessary, a setpoint opening duration Δt' is ascertained for the fuel injector, according to a rule of proportionality in a simple embodiment. Control time Δt" is now ascertained, preferably with the use of characteristic maps, from setpoint opening duration Δt' and pressure p in the high pressure accumulator, with the aid of which the fuel injector is then controlled.

What is claimed is:

1. A method comprising:

for each of a plurality of fuel injectors, ascertaining a respective representative value that is representative of a respective flow rate through the respective fuel injector, by ascertaining, during at least one respective injection process of the respective fuel injector, a ratio of (a) a pressure difference occurring in the high pressure accumulator as a result of the at least one respective injection process and (b) a respective duration associated with the at least one respective injection process; and based on a relationship between (a) the respective representative value ascertained for a particular one of the plurality of fuel injectors and (b) the respective representative values ascertained for the others of the plurality of fuel injectors, ascertaining, for the particular one of the plurality of fuel injectors, a respective correction value for correcting a respective fuel metering of the particular one of the plurality of fuel injectors so that the respective fuel metering of the particular one of the plurality of fuel injectors differs from fuel metering of others of the plurality of fuel injectors.

2. The method as recited in claim 1, wherein the respective representative value is ascertained from ratios of pressure difference and associated duration ascertained in multiple injection processes of the respective fuel injector.

3. A method for ascertaining a correction value for a fuel metering of a fuel injector of an internal combustion engine, in which fuel is injected from a high pressure accumulator into a combustion chamber with the aid of the fuel injector, the method comprising:

ascertaining a representative value that is representative for a static flow rate through the fuel injector, by ascertaining, during at least one injection process of the fuel injector, a ratio of a pressure difference occurring in the high pressure accumulator as a result of the injection process and an associated duration which is characteristic for the injection process, wherein the representative value is ascertained from a mean value of ratios of pressure difference and associated duration ascertained in multiple injection processes of the fuel injector; and ascertaining the correction value based on a comparison of the representative value and a comparative value.

4. A method for ascertaining a correction value for a fuel metering of a fuel injector of an internal combustion engine, in which fuel is injected from a high pressure accumulator into a combustion chamber with the aid of the fuel injector, the method comprising:

ascertaining a representative value that is representative for a static flow rate through the fuel injector, by ascertaining, during at least one injection process of the fuel injector, a ratio of a pressure difference occurring in the high pressure accumulator as a result of the injection process and an associated duration which is characteristic for the injection process; and ascertaining the correction value based on a ratio of the representative value and a mean value of corresponding representative values of all fuel injectors of the internal combustion engine.

5. The method as recited in claim 4, wherein the mean value of the corresponding representative values of all fuel injectors of the internal combustion engine is adjusted in such a way that a desired fuel-oxygen ratio in exhaust gas is not changed.

6. The method as recited in claim 1, wherein the respective duration corresponds to at least one of: (i) an actual opening duration of the respective fuel injector, (ii) a setpoint opening duration of the respective fuel injector, (iii) a control time of the respective fuel injector, and (iv) a closing time of the respective fuel injector.

7. The method as recited in claim 1, wherein the correction value is utilized for correcting a value for a static flow rate used in ascertaining setpoint durations characteristic for the injection process.

8. The method as recited in claim 1, wherein processes increasing a pressure in the high pressure accumulator are prevented during the at least one respective injection process.

9. A processing unit comprising a processor, wherein the processor is configured to:

for each of a plurality of fuel injectors, ascertain a respective representative value that is representative of a respective flow rate through the respective fuel injector, by ascertaining, during at least one respective injection process of the respective fuel injector, a ratio of (a) a pressure difference occurring in the high pressure accumulator as a result of the at least one respective injection process and (b) a respective duration associated with the at least one respective injection process; and based on a relationship between (a) the respective representative value ascertained for a particular one of the plurality of fuel injectors and (b) the respective representative values ascertained for the others of the plurality of fuel injectors, ascertain, for the particular one of the plurality of fuel injectors, a respective correction value for correcting a respective fuel metering of the particular one of the plurality of fuel injectors so that the respective fuel metering of the particular one of the plurality of fuel injectors differs from fuel metering of others of the plurality of fuel injectors.

10. A non-transitory machine-readable memory medium, on which is stored a computer program that is executable by a processor and that, when executed by the processor, causes the processor to perform a method, the method comprising:

for each of a plurality of fuel injectors, ascertaining a respective representative value that is representative of a respective flow rate through the respective fuel injector, by ascertaining, during at least one respective injection process of the respective fuel injector, a ratio of (a) a pressure difference occurring in the high pressure accumulator as a result of the at least one respective injection process and (b) a respective duration associated with the at least one respective injection process; and based on a relationship between (a) the respective representative value ascertained for a particular one of the plurality of fuel injectors and (b) the respective representative values ascertained for the others of the plurality of fuel injectors, ascertaining, for the particular one of the plurality of fuel injectors, a respective correction value for correcting a respective fuel metering of the particular one of the plurality of fuel injectors so that the respective fuel metering of the particular one of the plurality of fuel injectors differs from fuel metering of others of the plurality of fuel injectors.

11. A method comprising:

for each of a plurality of fuel injectors, measuring a change in pressure that occurs during an injection period;

obtaining an average of the measured changes in pressure measured for the plurality of fuel injectors;

comparing the change in pressure measured for a particular one of the plurality of fuel injectors to the obtained average; and determining, based on the comparison, a fuel metering correction value for a fuel metering by the particular one of the plurality of fuel injectors into a combustion engine.

12. The method as recited in claim 11, wherein the change in pressure that occurs during the injection period is measured as a ratio of the change in pressure to a change in time.

13. The method as recited in claim 11, wherein the comparing is performed by obtaining a ratio of the change in pressure measured for the particular one of the plurality of fuel injectors to the obtained average.

14. The method as recited in claim 11, wherein each of the measured changes in pressure that occurs during the injection period is a respective average of the measured change in pressure obtained for the respective fuel injector in each of a plurality of injection processes.

* * * * *